US006454550B1

(12) United States Patent
Sun et al.

(10) Patent No.: US 6,454,550 B1
(45) Date of Patent: Sep. 24, 2002

(54) WELD STRENGTHENING COMPONENT FOR SEALED COMPRESSORS

(75) Inventors: Zili Sun; Gregory W. Hahn; Sudarshan K. Narasipura, all of Arkadelphia, AR (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/816,178

(22) Filed: Mar. 23, 2001

(51) Int. Cl.[7] ..... F04C 18/04
(52) U.S. Cl. ..... 418/55.1; 418/270; 417/902
(58) Field of Search ..... 418/55.1, 270; 417/902

(56) References Cited

U.S. PATENT DOCUMENTS 2,065,162 A * 12/1936 Trask ..... 417/902
2,629,544 A * 2/1953 Ohmart ..... 417/902
5,287,844 A * 2/1994 Grassbaugh et al. ..... 418/55.1
5,772,411 A * 6/1998 Crum et al. ..... 418/55.1

* cited by examiner

*Primary Examiner*—John J. Vrablik
(74) *Attorney, Agent, or Firm*—Carlson, Gaskey & Olds

(57) ABSTRACT

A sealed compressor includes a lower end cap with a u-shaped hump extending around its periphery. A weld reinforcement which is preferably a ring is welded between inner and outer legs of the u-shaped hump. The weld reinforcement ring bears a good deal of stress from internal pressures, and results in a more long-lasting housing.

8 Claims, 2 Drawing Sheets

WELD STRENGTHENING COMPONENT FOR SEALED COMPRESSORS

BACKGROUND OF THE INVENTION

This invention relates to a strengthening component added to a housing shell for a sealed compressor.

Refrigerant compressors are typically provided in a sealed housing. In such sealed compressors, the refrigerant is typically allowed to flow over a motor for driving a compressor pump unit and to cool the motor. In such housings, it is typically necessary to provide a fluid tight seal. Typically, a cylindrical center shell extends between the two ends of the compressor housing, and end caps are welded to each end of the center shell. The motor is mounted adjacent one end, which for purposes of this application will be referred to as the lower end. A pump unit is mounted near the opposed end, which for purposes of this application will be referred to as the upper end. While the terms "upper" and "lower" typically imply a vertical orientation, it should be understood that this application would also cover housings wherein the compressor is mounted horizontally, or some combination of horizontal and vertical. Thus, the term "lower end" for describing one of the end caps should be interpreted to simply require the end cap adjacent the motor.

One type of modem compressor which has proven quite successful is a scroll compressor. In a scroll compressor, a pair of scroll members each include a generally spiral wrap extending from a base. The two wraps interfit to define compression chambers. The motor drives one of the two scroll members to orbit relative to the other, and as the two orbit the compression chambers defined between the two decrease in volume, compressing an entrapped refrigerant.

The interior of a sealed compressor housing is sometimes subject to relatively high pressure. Thus, burst testing is performed on the housing shells. The lower end cap utilized in sealed compressors frequently has a generally u-shaped hump formed in it. The outer periphery of this hump served as an alignment or guiding surface for the lower end of the center shell. During burst testing, this u-shaped hump has proved to be a weak point in the end cap, and has sometimes been subject to deformation, and failure. Thus, it would be desirable to strengthen the u-shaped hump in the lower end cap.

SUMMARY OF THE INVENTION

In the disclosed embodiment of this invention, a separate weld reinforcement member is positioned within a generally u-shaped structure in a lower end cap of a sealed compressor. More preferably, the u-shape extends circumferentially around the entire periphery of the compressor, although, in one embodiment there are circumferentially spaced portions. The weld reinforcement in the preferred embodiment is a ring which also extends along the entire circumference. The ring preferably has a slanted interior facing surface which will meet with a corresponding surface on a central portion of the lower end cap. The weld ring is first tack welded, then welded to both radially inner and outer surfaces of the end cap. The weld reinforcement provides a surface to bear the forces from the internal pressures, and relieve the transition of these forces through the relatively weak u-shaped hump.

Preferably, the weld reinforcement member is welded to both legs of the u-shape, and is spaced away from the end of the u-shape.

The present invention thus provides a lower end cap which is better resistant to the internal pressures in a sealed compressor. These and other features of the present invention can be best understood from the following specification and drawings, the following of which is a brief description.

DETAILED DESCRIPTION OF A PREFERRED EMBODIMENT

Figure 1:
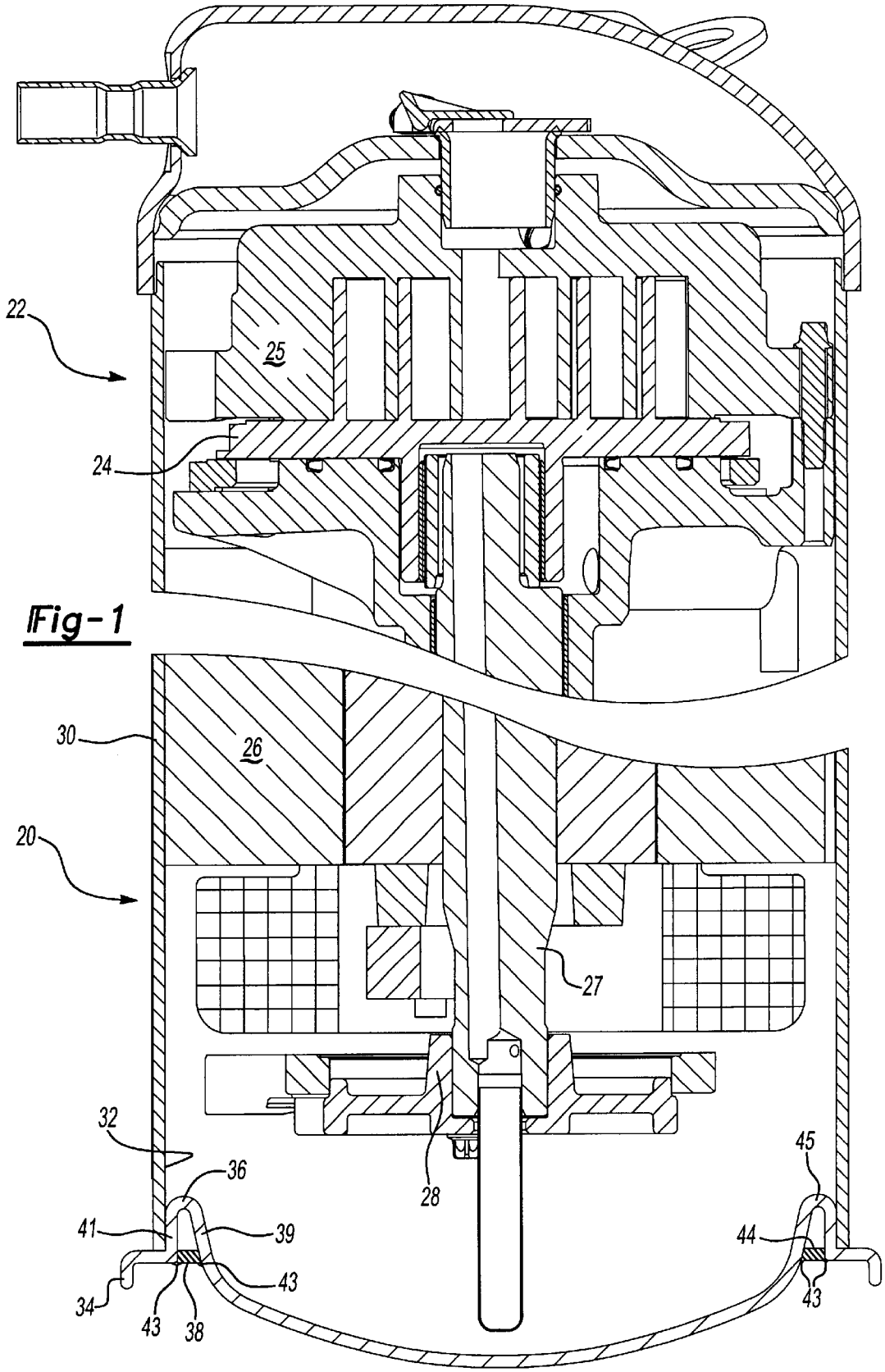
FIG. 1 is a cross-sectional view through a sealed compressor incorporated in the present invention.

A sealed compressor 20 is illustrated in FIG. 1. Sealed compressor 20 has a compressor pump unit 22 shown to be a scroll compressor pump unit having an orbiting scroll 24 and a non-orbiting scroll 25. Although the compressor is shown as a scroll compressor, it should be understood that other types of rotary compressors would also benefit from this invention.

An electric drive motor 26 drives a shaft 27 supported in a bearing 28. A center shell 30 has an inner peripheral surface 32 which seats outwardly of a unshaped hump 36 on a lower end cap 34. The hump 36 provides a guiding surface for guiding the center shell and positioning the center shell relative to the lower end cap 34.

As shown, a weld reinforcement member 38 is welded between inner leg 39 and outer leg 41 of the hump 36. As shown, weld joints 43 are formed to both of the surfaces 39 and 41 and the part 38. As also shown, there is preferably a clearance space 44 between the end 45 of the unshaped hump and member 38. The reinforcement is preferably formed of an appropriate steel.

Figure 2A:
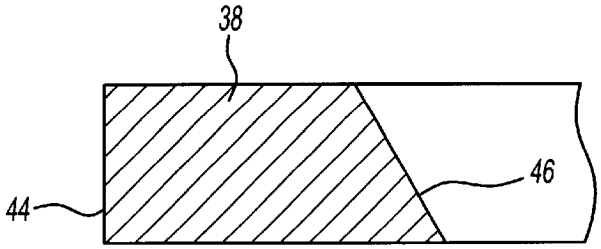
FIG. 2A is a cross-sectional view through an inventive weld ring.

As can be appreciated from FIG. 2A, the part 38 has a generally cylindrical outer surface 44 which seats within leg 41 and an angle or slanted surface 46 which lies along leg 39. Leg 39 can be seen to also be slanted, and generally corresponding to the surface 46.

Figure 2B:
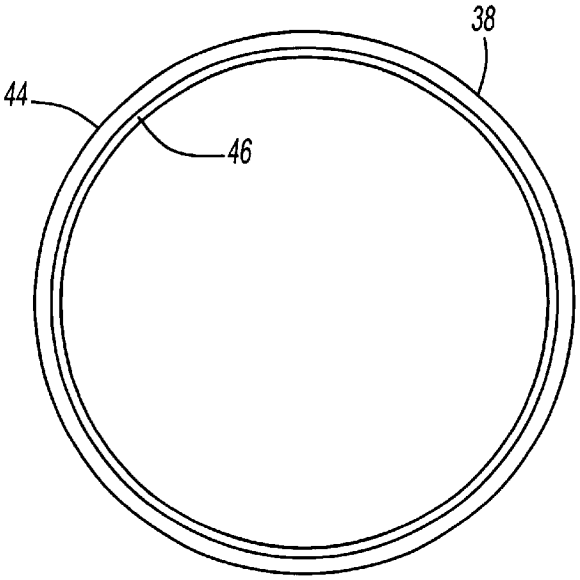
FIG. 2B is a top view.

As shown in FIG. 2B, the ring 38 generally extends circumferentially around the entire periphery of hump 36, and within the entire inner periphery of the shell 30.

Figure 3:
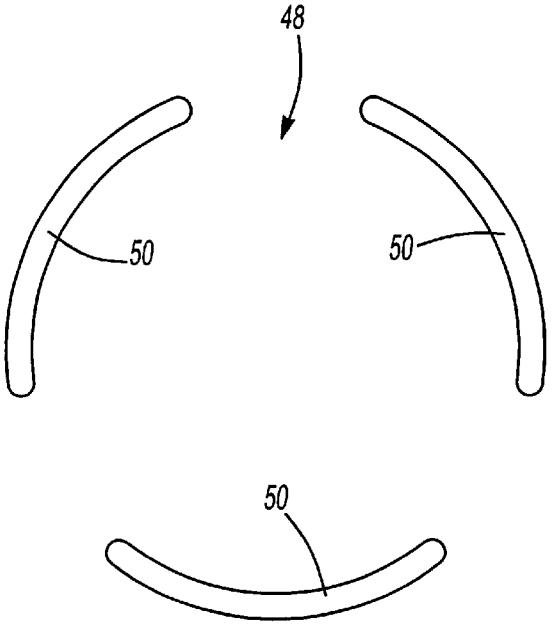
FIG. 3 shows a second type of an end cap which may also benefit from this invention.

FIG. 3 shows another embodiment 48. In embodiment 48, there is not a single circumferentially extending hump, but rather a plurality of circumferentially distinct hump portions 50. It should be understood that weld reinforcement portions similar to the ring 38 could be mounted within each of the distinct portions 50.

Figure 4:
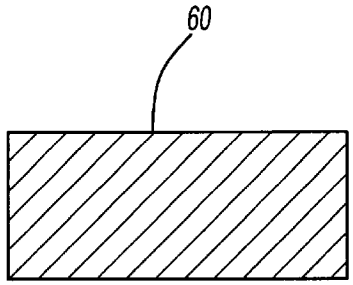
FIG. 4 shows another embodiment.

FIG. 4 shows an embodiment 60 where the cross-section of the weld reinforcement is generally rectangular.

Although preferred embodiments of this invention have been disclosed, a worker in this art would recognize that certain modifications would come within the scope of this invention. For that reason, the following claims should be studied to determine the true scope and content of this invention.

What is claimed is:

1. A sealed compressor comprising:

a compressor pump unit and a motor, said motor mounted at one end, and said compressor pump unit mounted adjacent a second end, both said compressor pump unit and said motor being mounted within a sealed housing;

said sealed housing including a generally cylindrical center shell extending between said first and second ends, with a first end cap mounted to said center shell adjacent said first end; and a second end cap secured to said center shell adjacent said second end, said second end cap having a generally u-shaped hump defining radially inner and outer legs of said u-shaped hump, and a weld reinforcement welded to each of said inner and outer legs within said u-shaped hump.

2. A sealed compressor as recited in claim 1, wherein said compressor pump unit is a scroll compressor.

3. A sealed compressor as recited in claim 1, wherein said un-shaped hump includes a plurality of circumferentially spaced un-shaped portions.

4. A sealed compressor as recited in claim 1, wherein said weld reinforcement has a slanted inner peripheral surface, and an outer peripheral surface of said inner leg has a corresponding slanted surface.

5. A sealed compressor as recited in claim 1, wherein said weld reinforcement is spaced from an end of said hump, such that there is a clearance space between said weld reinforcement and said hump.

6. A sealed compressor as recited in claim 1, wherein said hump extends around the entire circumference of said cylindrical center shell.

7. A sealed compressor as recited in claim 6, wherein said weld reinforcement extends around the entire circumference of said u-shaped hump.

8. A sealed compressor comprising:

a compressor pump unit and a motor, said motor mounted at a first end, and said compressor pump unit mounted adjacent a second end, both said compressor pump unit and said motor being mounted within a sealed housing;

said sealed housing including a generally cylindrical center shell extending between said first and second ends, with a first end cap mounted to said center shell adjacent said first end; and a second end cap secured to said center shell adjacent said second end, said second end cap having a generally u-shaped hump defining radially inner and outer legs of said u-shaped hump, and a weld reinforcement welded to each of said inner and outer legs within said u-shaped hump, said hump extending around an entire circumference of said cylindrical center shell, and said weld reinforcement also extending around the entire circumference, said weld reinforcement having a slanted inner peripheral surface and an outer peripheral surface of said inner leg having a corresponding slanted surface, and said weld reinforcement being spaced from an end of said u-shaped hump such that a clearance space is formed between said weld reinforcement and said end of said un-shaped hump.

* * * * *

UNITED STATES PATENT AND TRADEMARK OFFICE

CERTIFICATE OF CORRECTION

PATENT NO. : 6,454,550 B1
DATED : September 24, 2002
INVENTOR(S) : Sun et al.

It is certified that error appears in the above-identified patent and that said Letters Patent is hereby corrected as shown below:

Column 3,
Lines 14 and 15, “un-shaped” should read -- u-shaped --;

Column 4,
Line 27, “un-shaped” should read -- u-shaped --.

Signed and Sealed this

Fourth Day of February, 2003

JAMES E. ROGAN
*Director of the United States Patent and Trademark Office*